United States Patent [19]

Good

[11] Patent Number: 4,890,560

[45] Date of Patent: Jan. 2, 1990

[54] STACKABLE CIRCULAR SKID

[76] Inventor: Bruce R. Good, 54 Tanya Ct., Plantsville, Conn. 06479

[21] Appl. No.: 371,252

[22] Filed: Jun. 26, 1989

[51] Int. Cl.[4] ..... B65D 19/00

[52] U.S. Cl. ..... 108/53.1; 108/55.1; 108/53.3

[58] Field of Search ..... 108/53.1, 53.3, 53.5, 108/55.1, 54.1, 55.5, 55.3; 206/600, 598, 599, 596

[56] References Cited

U.S. PATENT DOCUMENTS

| | | | |
|---|---|---|---|
| 2,448,447 | 8/1948 | Lay | 248/120 |
| 2,507,588 | 5/1950 | Brandon et al. | 248/120 |
| 2,916,239 | 12/1959 | Stopps | 108/53.5 X |
| 3,521,764 | 7/1970 | Loomis | 108/53.1 X |
| 3,526,195 | 9/1970 | Maryonovich | 108/53.1 |
| 3,541,977 | 11/1970 | Waldman | 108/53 |
| 3,654,875 | 4/1972 | Vik | 108/51 |
| 3,695,187 | 10/1972 | Weiss | 108/54 |
| 3,858,723 | 1/1975 | Weiss | 206/386 |
| 4,007,694 | 2/1977 | Fowler et al. | 108/55.1 |
| 4,257,523 | 3/1981 | Blasio | 108/55.3 X |
| 4,403,556 | 9/1983 | Van Gompel | 108/55.5 X |
| 4,664,206 | 5/1987 | Stokes | 206/386 |
| 4,732,528 | 3/1988 | Good | 414/786 |
| 4,805,777 | 2/1989 | Mandel | 108/55.1 X |
| 4,829,909 | 5/1989 | Mandel | 108/54.1 X |

*Primary Examiner*—Kenneth J. Dorner
*Assistant Examiner*—José V. Chen
*Attorney, Agent, or Firm*—Ira S. Dorman

[57] ABSTRACT

A circular skid is provided with structure for internally accommodating banding material, and is adapted to be transported from place-to-place by rolling on edge. The skid is especially suited for carrying one or more coils of product of a range of diameters, and a number of the skids can be stacked, one upon another.

17 Claims, 3 Drawing Sheets

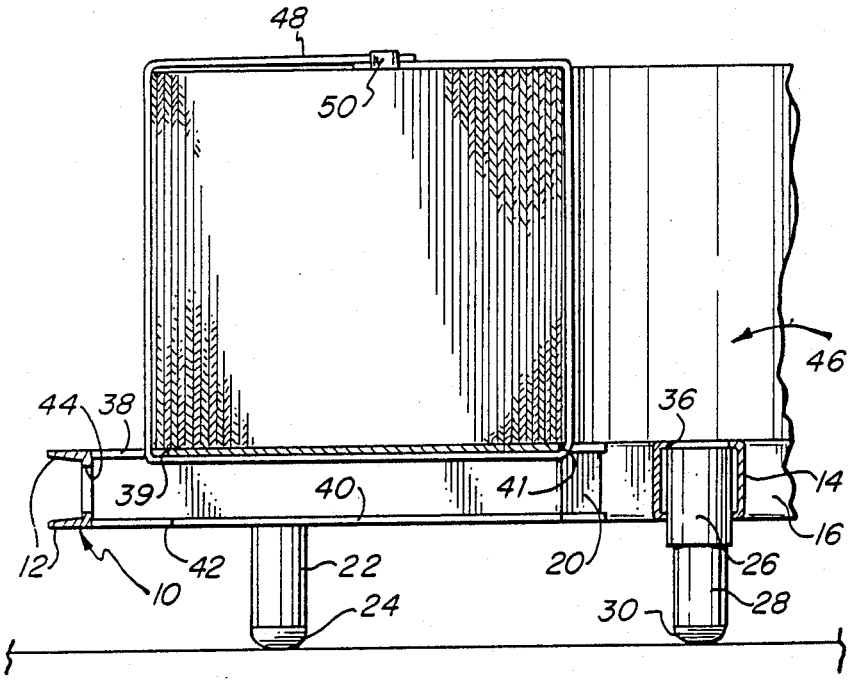
FIG. 8
FIG. 9
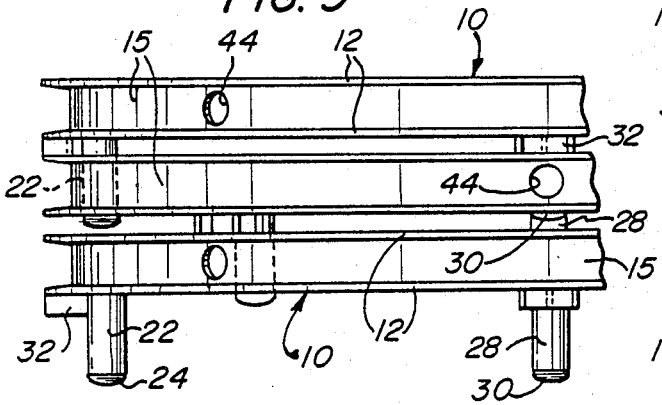
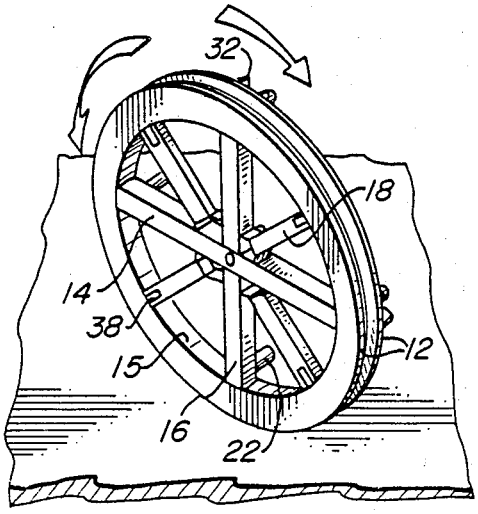
FIG. 11
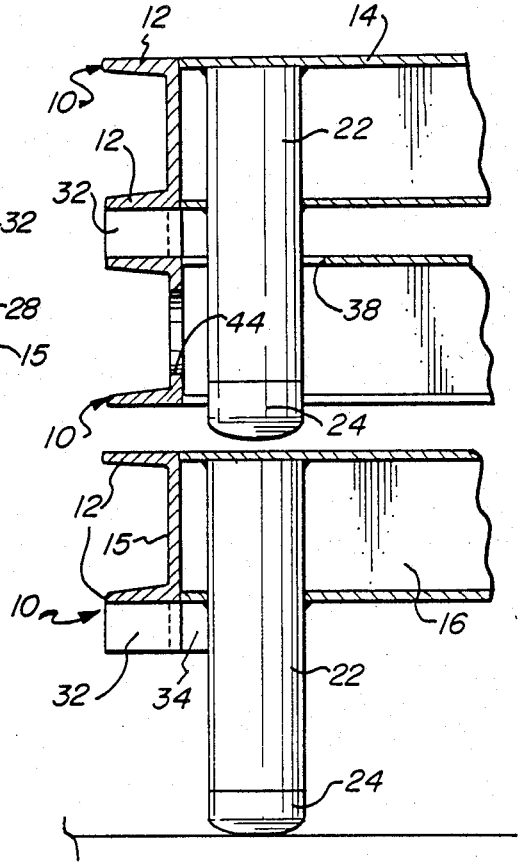
FIG. 10

STACKABLE CIRCULAR SKID

BACKGROUND OF THE INVENTION

Skids and pallets are of course in common use for transporting a wide variety of products. A circular pallet, intended to support a stack of spirally wound rolls of steel strapping, is shown in U.S. Pat. No. 2,507,588 to Brandon et al; a square skid, which is also intended for transporting products of coiled form, is described in Good U.S. Pat. No. 4,732,528.

Typically, the supported product will be secured in place during transport, and such units will therefore normally be designed to accommodate straps or bands for that purpose. The above-mentioned Brandon et al patent, for example, uses its vertically oriented tubular spacing pillars for the receipt of banding material. In the Good patent securing bands are passed through circular apertures provided in the sidewalls of three supports comprising the skid structure.

It will generally be an important feature of such skids and pallets that they be adapted for shipment in bulk, since the intent will normally be that they be returned for reuse. This, coupled with the fact that they will usually be subjected to heavy loadings and rough shipping conditions, demands that the pallets and skids be of strong and durable construction, thus making many conventional structures quite heavy and cumbersome, and difficult to handle.

Accordingly, it is an object of the present invention to provide a novel, circular skid that is so constructed as to enable edgewise rolling, and to afford protection for the banding material used to hold the product in place.

It is also an object of the invention to provide such a skid which is readily stacked with other, like skids for efficient shipment in bulk, which is especially well suited for forklift conveyance, is strong and durable, and provides good protection for the product carried thereby.

Other objects of the invention are to provide such a skid which is of relatively light-weight, uncomplicated and inexpensive construction, and also to provide a novel assembly and a novel stack of skids utilizing the same.

SUMMARY OF THE INVENTION

It has now been found that certain of the foregoing and related objects of the invention are readily attained by the provision of a skid that includes a circular ring member providing outermost circumferential edge structure that is adapted to enable rolling of the skid thereon. A multiplicity of hollow, elongated arm members extend radially, with respect to the geometric center of the ring member, and are joined to one another at their inner ends and to the ring member at their outer ends; at least certain of the arm members are open at both ends to permit passage of banding material therethrough and upwardly therefrom. A plurality of legs extend downwardly to support the skid on a flat surface, and the skid has openings that are dimensioned, configured and located so as to receive the legs of a similar skid stacked on top of it. A coil of product, supported by coplanar surface elements on the skid, can therefore be secured in place by a band of material passed through at least one of the hollow arm members.

In preferred embodiments the ring member of the skid will be made of channel stock of generally U-shaped cross section, so oriented that the lateral flange elements on its base element are outwardly directed. The arm members will, in such embodiments, be provided by tubular pieces of generally rectangular cross section, and most desirably the innermost margins of the end openings thereof will be defined by generally rectilinear edge elements. It will also be preferred for the underside of each hollow arm member to be slotted along its entire length to facilitate the insertion of banding material thereinto, and the inner end of each such arm member will desirably be formed into a pair of flange elements extending outwardly therefrom at an angle to its longitudinal axis, thus providing means for joining the arm members to one another.

Other arm members will desirably be provided by two perpendicular crosspieces, each extending at least substantially continuously across the ring member. The legs of the skid will normally be mounted thereupon, one leg being disposed at the intersection of the crosspieces and the others being located adjacent the outer ends thereof; in those instances, the openings at the outer ends of the hollow arm members will be adapted to receive, and to loosely engage, the "other" legs therewithin. The skid may additionally include a plurality of spacing elements positioned beneath the ring member on its circumferential edge structure and at spaced locations thereabout, such elements being adapted to maintain vertical separation between stacked skids.

Other objects of the invention are attained by the provision of a stack of skids, each having the structural features hereinabove described. The skids are stacked upon one another, with the underlying skids receiving the legs of the directly overlying skid within the openings provided.

Further objects are attained by the provision of a skid assembly comprised of a skid, as hereinabove described, and a coil of product supported upon it. The assembly additionally includes at least one band of banding material passed through one of the hollow arm members and about the coil, to secure it in place.

BRIEF DESCRIPTION OF THE DRAWINGS

FIG. 8 is a fragmentary sectional view taken along line 8—8 of FIG. 1, and drawn to a scale enlarged therefrom;

FIG. 9 is a fragmentary elevational view showing a stack of the skids of the present invention;

FIG. 10 is a fragmentary sectional view of a peripheral portion of the stack of FIG. 9, drawn to an enlarged scale; and FIG. 11 is a perspective view illustrating one of the skids of the invention being rolled upon the ground.

DETAILED DESCRIPTION OF THE ILLUSTRATED EMBODIMENTS

Figure 1:
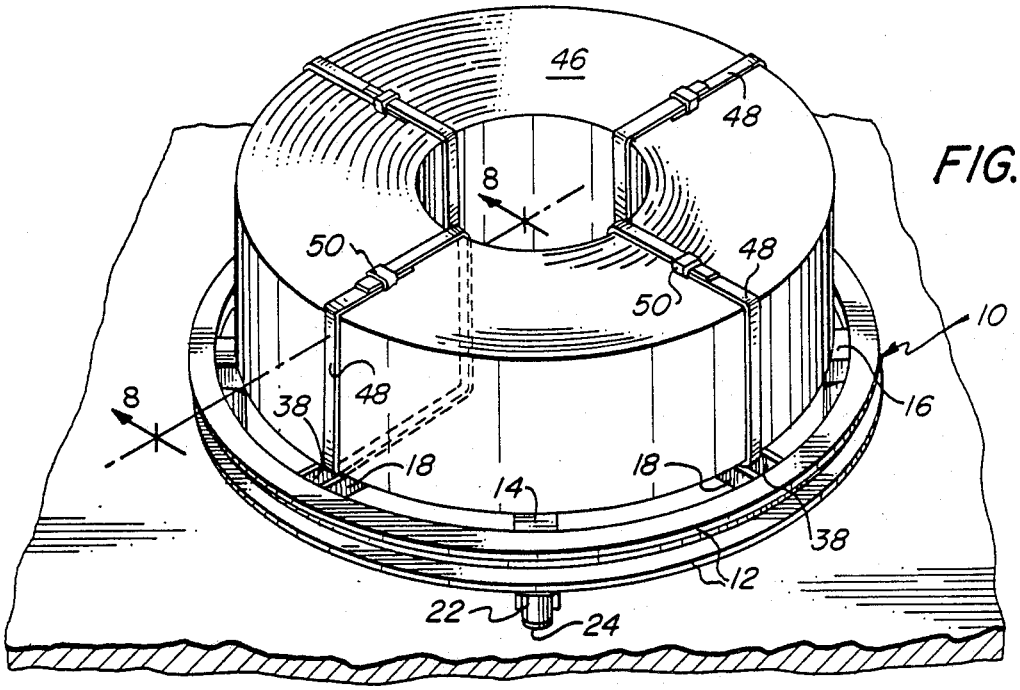
FIG. 1 is a perspective view showing the skid of the invention, with a coil of material supported thereupon and secured in place.

Turning now in detail to the appended drawings, therein illustrated is a skid embodying the present invention and including a channel piece of U-shaped cross section, formed into the ring-like structure generally designated by the numeral 10; the channel piece is oriented with its flange portions 12 outwardly directed. A crossmember 14 extends diametrically across the ring structure 10, and a pair of crosspieces 16 extend at right angles thereto on a perpendicular diameter (thus lying on axes that intersect at the geometric center of the ring). The crosspieces 16 are welded to the crossmember 14 at the points of intersection therewith, and the outer ends thereof are welded against the back face of the base element 15 of the ring structure 10.

Four arms, each generally designated by the numeral 18, extend radially from the center of the skid at 45° angles to the crossmember 14 and the crosspieces 16, in alternating relationship thereto; like the crossmember and crosspieces, the arms 18 are constructed from lengths of square tubing, and are welded against the back face of ring element 15. Rectangular sections of the upper and lower panels of the tubing are cut away to define flange elements 20 on the radial arms 18, which are bent outwardly at 45° angles to the longitudinal axes thereof; the ends of the flanges 20 are welded to the crossmember 14 and crosspieces 16, to join them thereto.

A depending leg, provided by a length of cylindrical pipe 22 and a rounded end cap 24, is welded adjacent the outer ends of the crossmember 14, and adjacent the outer end of each crosspiece 16; a similar leg, consisting of a cylindrical sleeve 26, a pipe piece 28 and an end cap 24, is secured at the center of the skid within the crossmember 14. A short element 32 of channel stock is welded to the lower of the two flange portions 12, at a point adjacent each of the four perimetric legs, and is oriented perpendicularly to the channel of the ring structure 10. Gussets 34 are secured behind the elements 32 and against the pipe 22 of the corresponding leg, to reinforce it.

Figure 2:
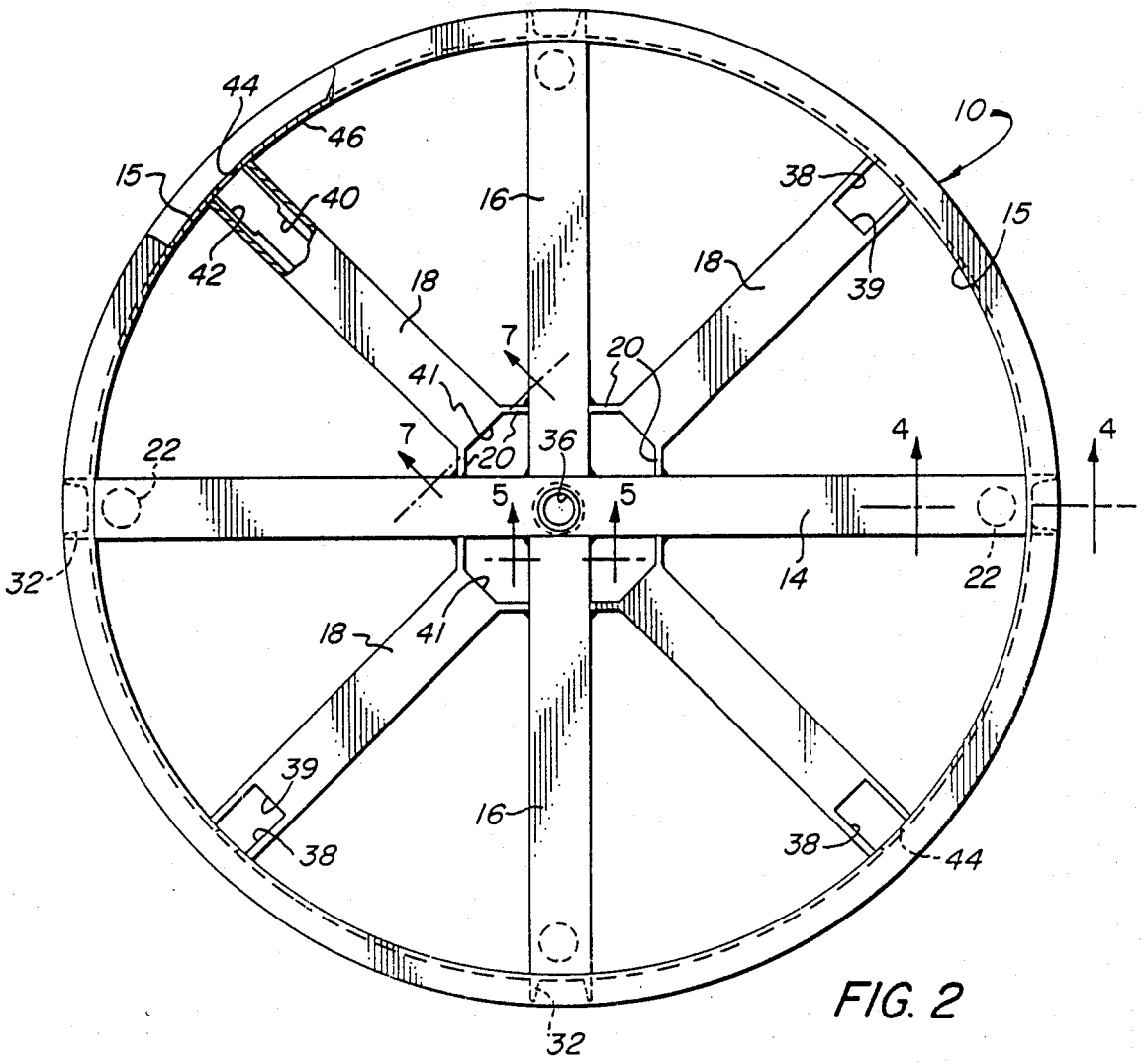
FIG. 2 is a top plan view of the skid of FIG. 1, drawn to a scale somewhat enlarged therefrom.
Figure 3:
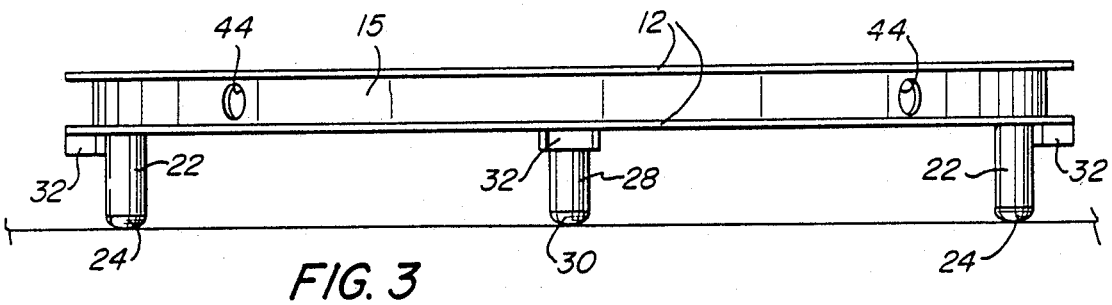
FIG. 3 is an elevational view of the skid.
Figure 4:
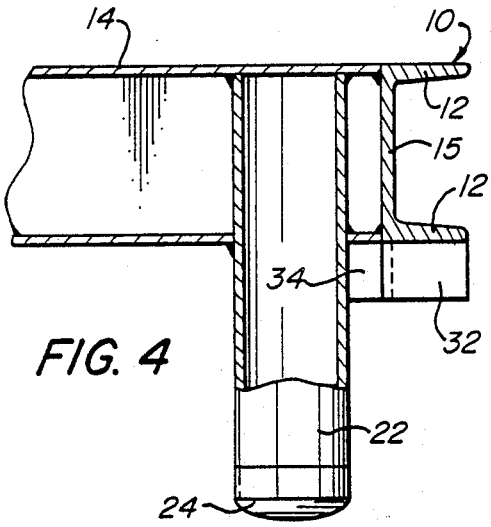
FIG. 4 is a fragmentary sectional view of the skid, taken along line 4—4 of FIG. 2 and drawn to a scale further enlarged therefrom.
Figure 5:
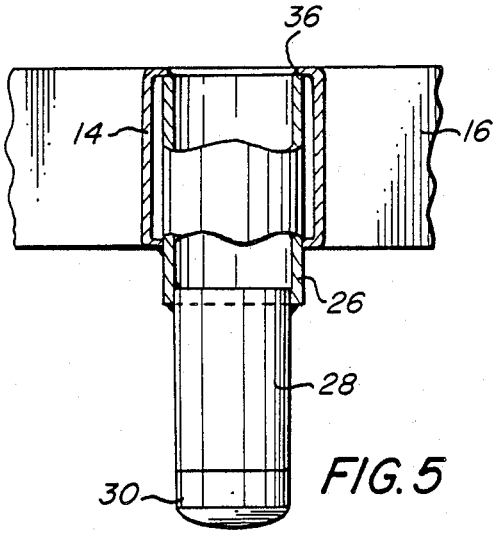
FIG. 5 is a fragmentary sectional view taken along line 5—5 of FIG. 2, and drawn to the scale of FIG. 4.
Figure 6:
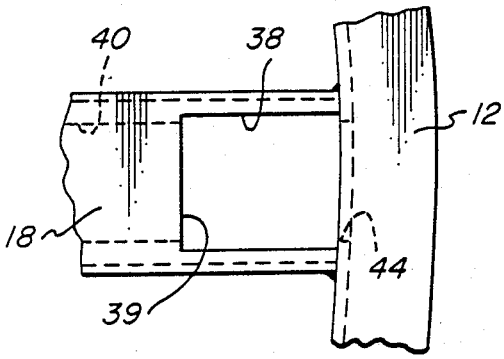
FIG. 6 is a fragmentary plan view of a peripheral section of the skid.
Figure 7:
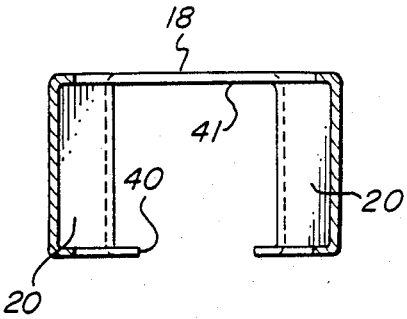
FIG. 7 is a fragmentary sectional view taken along line 7—7 of FIG. 2.

As best seen in FIGS. 2 and 5, a circular hole 36 is formed through the crossmember 14 at the geometric center of the skid. Each of the radial arms 18 has a square indentation 38 extending from its outer end, formed through the upper panel of the tube from which it is made. The lower panels of the arms 18 are formed with slots 40 that extend along their entire length and that terminate in slightly widened rectangular openings 42, the openings corresponding to the indentations 38 of the upper panels and being aligned with them. Circular apertures 44 are formed through the inner portion 46 of the ring structure 10 at the ends of the arms 18, and may be used for attaching cables or the like to facilitate mechanized lifting of the skid.

With particular reference now to FIGS. 1 and 8, a coil of material (e.g., of sheet metal), generally designated by the numeral 46, is carried on the skid with one of its flat sides resting upon the coplanar upper surfaces of the several radial components 14, 16, 18; it will be noted that the central axis of the coil 46 is substantially aligned with that of the skid. The coil 46 is secured to the skid by four bands 48 of encircling steel strapping, each band being partially contained within one of the radial arms 18 and being affixed tightly about the coil 46 by a conventional fastener 50. The bands 48 enter the passages of the arms 18 through the open inner ends thereof and through the indentations 38 at their outer ends; since the points of transition are defined by rectilinear edges 39 and 41, the banding material will not be transversely distorted as a result. Although only a single coil 46 is shown in the figures, it will be self evident that several of them could be stacked, one upon another, and carried by a single skid, normally with sticks or other spacers interposed to facilitate removal and to protect the exposed edges of the coiled product from damage.

FIGS. 9 and 10 show a stack of the skids of the invention. As best seen in FIG. 10, the perimetric legs of each overlying skid are received within the indentation 38 and slot enlargements 42 of the underlying radial arms 18, the superimposed skids being angularly displaced from one another to achieve the necessary alignment. It will be appreciated that the legs could be accommodated simply by so orienting the skids as to permit them to enter the spaces between adjacent radial components 14, 16, 18, such as in cases in which a leg or legs are so bent or damaged as to prevent entry into a socket provided. However, engagement within the indentations 38 and the enlarged slot portions 42 is advantageous from the standpoint of affording secure and stable interconnection, since a relatively snug fit, or at least loose interengagement, will be produced. As depicted in FIG. 11, the skids are conveniently moved manually by rolling them on edge; the flange elements 12 of the ring member 10 are ideally constructed and configured for that purpose, and the legs spaced about the circumference of the skid provide convenient handles. It will be self evident that when a number of the skids are assembled as described, with their legs received within the indentations 38 and slot portions 42 of the adjacent radial arms 18, they will tend to stay together and to roll as a unit. They may of course be strapped or banded if preferred, and that will indeed be the normal way in which stacks of the skids will be prepared for shipment.

FIGS. 9 and 10 also show the function of the channel pieces 32, which is to maintain spacing between the adjacent skids of a stack so as to thereby avoid "pinch points" at which the fingers of personnel handling the skids might otherwise be caught and injured. Spacing the skids from one another also facilitates their removal from the stack.

The use of hollow radial members, with appropriately located access points, is a feature of primary importance to the invention. Not only does it enable the banding material to be applied in desirable configurations, but moreover, because sections of the material that would otherwise be vulnerable are contained within the radial arms, protection is afforded against breakage and other damage or distortion.

Loaded skids of this type are usually conveyed from place-to-place on a forklift truck. The tines of the fork normally bear, and often impact, upon the lower surface of the supporting structure, and therefore frequently cause damage to the exposed banding or strapping material. The incidence of damage increases with time, moreover, due to the tendency for the banding material to loosen and droop. The skid of the present invention avoids those problems.

The provision of hollow radial arms is also advantageous from the standpoint of permitting insertion of the banding material prior to loading of the skid, thus facilitating its application. That capability is particularly desirable in those instances in which the load is large and cumbersome.

The skids of the invention will typically be about four feet in diameter, to enable them to handle coils of conventional size. It should be emphasized that a range of coil diameters may be accommodated on any given skid, bearing in mind that the load should not extend beyond its perimeter if advantage is to be taken of the highly protective nature of the channel stock that circumscribes the skid. It might also be mentioned that even loaded skids can be stacked, provided of course that the supported product is of suitable dimensions and configuration. Although the tops of the radial components may themselves provide the coplanar supporting elements, it may in some instances be preferred to cover the components with plastic or another material, to protect against marring or to provide other desirable characteristics.

Mounting of the legs on the skid in the manner illustrated is advantageous from the standpoint of permitting access by the fork truck from each of eight directions. In addition, the use of round pipes or posts for the legs will tend to deflect a misdirected fork, thereby helping to minimize leg damage. The rounded caps welded to the ends of the leg posts facilitate sliding of the skid on the floor, and they make the legs safer and more comfortable when used as handles for rolling of the skid.

Thus, it can be seen that the present invention provides a novel circular skid that is so constructed as to enable edgewise rolling, and to afford protection for the banding material used to hold the product in place. The skid is readily stacked with other, like skids for efficient shipment, it is well suited for forklift conveyance, and it provides good protection for the carried product; the skid is, in addition, of strong, durable, light weight, uncomplicated and inexpensive construction. The invention also provides a novel assembly, and novel skid stack arrangement utilizing the same.

Having thus described the invention, what is claimed is:

1. A skid adapted for carrying a coiled product, and adapted for stacking with other, like skids in unloaded condition, comprising:

a circular ring member providing circumferential edge structure disposed outermost on said skid, said edge structure being adapted for rolling of said skid thereon;

a multiplicity of elongated arm members extending radially with respect to the geometric center of said ring member, said arm members being joined to one another at their inner ends and being joined to said ring member at the outer ends thereof, each of at least certain of said arm members being at least substantially hollow and being open at both of its ends to permit passage of banding material therethrough and upwardly therefrom; and a plurality of legs downwardly extending on said skid and cooperating to support said skid on a flat surface, said skid having openings dimensioned, configured and located so as to receive the legs of an overlying like skid stacked thereupon, and having uppermost surface elements disposed in a common plane, whereby a coil of product, supported by said surface elements, can be secured to said skid by a band of banding material passed through at least one of said certain arm members.

2. The skid of claim 1 wherein said ring member is made of channel stock of generally U-shaped cross section, said channel stock consisting of lateral flange elements joined by a base element and said flange elements being outwardly directed on said skid.

3. The skid of claim 1 wherein each of said certain arm members is a tubular piece of generally rectangular cross section.

4. The skid of claim 3 wherein innermost margins of the end openings of each of said certain arm members are defined by generally rectilinear edge elements.

5. The skid of claim 1 wherein the underside of each of said certain arm members is slotted along its entire length so as to facilitate the insertion of banding material thereinto.

6. The skid of claim 1 wherein said inner end of each of said certain arm members comprises a pair of flange elements extending outwardly therefrom at an angle to the longitudinal axis thereof, said flange elements providing means by which said arm members are joined to one another.

7. The skid of claim 1 wherein others of said arm members are provided by two mutually perpendicular cross-pieces, both of said crosspieces extending at least substantially continuously across said ring member, said certain arm members being alternately disposed with said other arm members in angularly spaced positions within said ring member.

8. The skid of claim 7 wherein one of said legs is disposed at the intersection of said crosspieces, and the others of said legs are disposed thereon adjacent the outer ends thereof.

9. The skid of claim 8 wherein a plurality of said openings are disposed at said outer ends of said certain arm members, said plurality of said openings adapted to receive and loosely engage said other legs therewithin.

10. The skid of claim 1 additionally including a plurality of spacing elements disposed beneath said ring member on said circumferential edge structure and at spaced locations thereabout, said spacing elements being adapted to maintain said edge structure out of direct contact with the edge structure of another of said skids disposed therebeneath in a stack thereof.

11. A stack comprising a plurality of skids, each skid of said stack being adapted for carrying a coiled product and including:

a circular ring member providing circumferential edge structure disposed outermost on said skid, said edge structure being adapted for rolling of said skid thereon;

a multiplicity of elongated arm members extending radially with respect to the geometric center of said ring member, said arm members being joined to one another at their inner ends and being joined to said ring member at the outer ends thereof, each of at least certain of said arm members being at least substantially hollow and being open at both of its ends to permit passage of banding material therethrough and upwardly therefrom; and a plurality of downwardly extending legs on said skid and cooperating to support said skid on a flat surface, said skid having openings dimensioned, configured and located so as to receive the legs of an overlying like skid stacked thereupon, and having uppermost surface elements disposed in a common plane, whereby a coil of product, supported by said surface elements, can be secured to said skid by a band of banding material passed through at least one of said certain arm members, said skids being stacked one upon another with each underlying skid receiving, within said openings thereof, said legs of the directly overlying skid.

12. The stack of skids of claim 11 wherein, in each of said skids, others of said arm members are provided by two mutually perpendicular crosspieces, both of said crosspieces extending at least substantially continuously across said ring member thereof; one of said legs is disposed at the intersection of said crosspieces, and the others of said legs are disposed thereon adjacent the outer ends thereof; and the openings at said outer ends of said certain of arm members are adapted to receive and loosely engage said other legs therewithin, said skids being angularly oriented with respect to one another and said openings at said outer ends of said each underlying skid receiving said other legs of said overlying skid.

13. The stack of skids of claim 11 wherein each of said skids additionally includes a plurality of spacing elements disposed beneath said ring member on said circumferential edge structure and at spaced locations thereabout, said spacing elements maintaining said edge structures of said overlying and underlying skids out of direct contact with one another.

14. A skid assembly comprising a skid that is adapted for carrying a coiled product, and for stacking with other, like skids in unloaded condition, and a coil of product carried thereby and secured thereto, said skid including:

a circular ring member providing circumferential edge structure disposed outermost on said skid, said edge structure being adapted for rolling of said skid thereon;

a multiplicity of elongated arm members extending radially with respect to the geometric center of said ring member, said arm members being joined to one another at their inner ends and being joined to said ring member at the outer ends thereof, each of at least certain of said arm members being at least substantially hollow, and being open at both of its ends to permit passage of banding material therethrough and upwardly therefrom; and a plurality of downwardly extending legs on said skid and cooperating to support said skid on a flat surface, said skid having openings dimensioned, configured and located so as to receive the legs of an overlying like skid stacked thereupon, and having uppermost surface elements disposed in a common plane, said coil of product lying on a flat side and being supported by said surface elements of said skid with the central axis of said coil substantially aligned on said geometric center of said ring member; said assembly additionally including at least one band of banding material passed through one of said certain arm members and about said coil to secure said coil to said skid.

15. The assembly of claim 14 wherein each of said certain arm members of said skid is a tubular piece of generally rectangular cross section, and wherein said assembly includes a plurality of said bands, one of said bands being passed through each of said plurality of arm members and about said coil.

16. The assembly of claim 15 wherein innermost margins of the end openings of each of said certain arm members are defined by generally rectilinear edge elements, and wherein said banding material is in flat strip form, said banding material passing over said edge elements without substantial transverse distortion thereof.

17. The assembly of claim 14 wherein the underside of each of said certain arm members of said skid is slotted along its entire length so as to facilitate the insertion of said banding material thereinto.

* * * * *

UNITED STATES PATENT AND TRADEMARK OFFICE

CERTIFICATE OF CORRECTION

PATENT NO. : 4,890,560

DATED : January 2, 1990

INVENTOR(S) : Bruce R. Good

It is certified that error appears in the above-identified patent and that said Letters Patent is hereby corrected as shown below:

Claim 1, column 5, line 56, insert --downwardly extending-- before the word "legs"; cancel "downwardly extending" after the word "legs".

Claim 15, column 8, line 24, delete the words "plurality of" and substitute therefor --certain--.

Signed and Sealed this

Thirteenth Day of November, 1990

*Attest:*

*Attesting Officer*

HARRY F. MANBECK, JR.

*Commissioner of Patents and Trademarks*